United States Patent [19]

Metcalfe et al.

[11] 3,992,311

[45] Nov. 16, 1976

[54] REACTIVE DEVELOPER FOR ELECTROPHOTOGRAPHY

[76] Inventors: Kenneth A. Metcalfe, 1 Corona Ave., Lockleys, South Australia, Australia, 5032; Alwin S. Clements, 35 Alexander St., Largs Bay, South Australia, Australia, 5016

[22] Filed: July 24, 1975

[21] Appl. No.: 598,982

Related U.S. Application Data

[63] Continuation of Ser. No. 357,515, May 4, 1973, abandoned.

[30] Foreign Application Priority Data

May 15, 1972 Australia ..... 8949/72

[52] U.S. Cl. ..... 252/62.1 R; 252/62.12

[51] Int. Cl.[2] ..... G03G 9/12

[58] Field of Search ..... 252/62.1; 8/71

[56] References Cited

UNITED STATES PATENTS

| | | | |
|---|---|---|---|
| 3,535,244 | 10/1970 | Zabiak | 252/62.1 |
| 3,639,243 | 2/1972 | Okuno et al. | 252/62.1 |
| 3,720,619 | 3/1973 | Inoue et al. | 252/62.1 |
| 3,753,760 | 8/1973 | Hosel | 252/62.1 |

OTHER PUBLICATIONS

Giles et al., Part I, Journal of Chemical Society, 1952, pp. 3799–3805.

Arshid et al., Part II, Journal of Chemical Society, 1955, pp. 67–79.

Arshid et al., Part III, Journal of Chemical Society, 1956, pp. 72–75.

*Primary Examiner*—Jack P. Brammer

*Attorney, Agent, or Firm*—Haseltine, Lake & Waters

[57] ABSTRACT

A method for making an electrophotographic developer having developer particles suspended in an insulating carrier liquid comprising reactively producing the developer particles by placing into the carrier liquid at least two substances which are both soluble in the carrier liquid and are insulators relative to the carrier liquid and when in a dissolved state in the carrier liquid precipitate in the carrier liquid to form the developer particles. The developer particles are maintained in the carrier liquid so as to be shielded against oxidation until used as a developer.

7 Claims, No Drawings

REACTIVE DEVELOPER FOR ELECTROPHOTOGRAPHY

CROSS-RELATED APPLICATION

This Application is a continuation of Application Ser. No. 357,515 filed May 4, 1973 now abandoned and claims the priority of the Australian Application filed May 12, 1972.

This invention relates to method and means for making developers for electrostatic and electrophotographic images. The invention also relates to means for development and subsequent use of the developed image deposit.

STATE OF THE ART

The earlier forms of development of electrographic images employed dry powders which were applied to the surface of the sheet to be developed by a cascade method or as a powder cloud. A magnetic brush was later employed to carry the dry powder across the surface so that selective deposition could occur. Each of these methods involved the use of powders made by grinding or the like in air, and contamination of the surfaces of the powders during manufacture, storage and application could easily occur. A further characteristic of the dry powder method was that the image required fixing by heat fusion or the like after deposition and the powders thus required an admixture or attachment of a fusible medium such as resins.

In later processes, liquid development or electrophoretic and dielectrophoretic development from insulating liquids was introduced and this was capable of high resolution and better control of deposition.

One of the features of development of electrographic images is that both positive and negative development is possible and that neutralization may be effected where necessary, as well as controlled use of bi-polar particles and aggregates. Considerable work has been done to achieve ready control of reversal of image deposition.

One of the best known methods was what has been called "controlled development" in which a substance was added to the liquid developer which controlled, enhanced or retarded the immigration of particles or aggregates to the image either to produce a negative, positive or neutral result.

In these liquid systems, it is usual to disperse pigment particles, or dye, or polymer particles or globules in a liquid with relatively high electrical resistivity such as $10^{10}$ ohm centimeter and with a dielectric constant less than 3. The particles so dispersed will deposit according to the inherent charges on the particles and also according to the dielectric constant of the particles because an induced charged may add to the total charge or subtract from it. Many substances exist which will deposit under these conditions, but the introduction of a control substance gives a common and a better deposition which can be regulated to give better results, and this system is now in general use.

The mechanism for controlling the movement of particles in an electrically insulating liquid in the presence of a field is a complex one and many factors must be considered if the best results are to be obtained. These factors include for example, the ionic double layer around the particules or aggregates, the extent of dielectrophoretic effects and the effect of syneresis or the electrical interaction of particles on one another. A further requirement is to consider the conductivity of the toner particles. Another requirement is to consider particle size and concentration as well as chemisorption effects.

We have observed that one of the most important factors in the production of developers for electrophotographic purposes is the nature of the pigment or toner particles and particularly whether their surfaces have been impaired, altered or contaminated prior to dispersion in the carrier liquid. Insofar as both electrophoresis and dielectropheresis are concerned, a marked influence is exerted by the surface condition of the particles. In our "controlled" developer system, we modified this situation by grinding the particles to produce new fracture surfaces within a primary dispersion medium such as a resin, oil or surfactant, to produce as many new surfaces away from the air or other such oxidizing environment.

SUMMARY OF INVENTION

From the intensive research which we have carried out we have shown that the use, of pigments and the like made externally to the carrier liquid itself presents many problems because of the difficulty of protecting the particles from unwanted contamination which of course may seriously impair particle migration and the end use of the image deposit such as by for example, formation of electrical resists for overprinting or chemical resists for subsequent letterpress or lithographic printing.

We found that these uncertainties could be eliminated by forming the particles within the liquid carrier and it is clear that any pigment, dye or toner can be used if the components from which they are made can be introduced into the carrier liquid in solution or in a form precipitated within the carrier liquid.

Thus, we propose the use of substances which can be introduced into a carrier liquid which interact, or combine with or result in decomposition products which have the desired properties of color, chemical response and the like in an electrographic context.

According to this invention, the substances which react must not themselves impair the resistivity of the carfier liquid.

The requirement of good insulation characteristics in a developer are of course obvious when it is realized that where a latent image exists on a photoconductive surface, such image will be destroyed, at least in part, during development.

Accordingly, one object of the present invention is to make developer particles and aggregates within an insulating carrier liquid in order to exclude the possibility of oxidation or other unwanted contamination due to exposure to air or other contaminating gas.

Another object of this invention is to make particles or aggregates within the carrier liquid so as to exclude the difficulties ordinarily encountered in wetting dry pigments and powders properly with resins, oils and the like so as to achieve control of their migration in the liquid when under the influence of an electric field or when subjected to selective chemisoption by the surfaces on which they are placed.

Another object of this invention is to associate the particles with adhesives or fixatives or chemically combining agents which enable the total aggregates which are produced by the method to be fixed to the receiving surface.

DETAILS OF THE INVENTION

According to the invention, there is provided a developer for electrophotography of the type which uses an insulating carrier liquid having suspended therein developer particles capable of being moved in an electrical field, but which developer is reactively produced by placing into a solvent, which may be the final carrier liquid, at least two substances which are relative insulators and form, when in a dissolved state in the solvent, another solution which precipitates to form developer particles which may be conductive but are non-ionic, whereby the developer particles are themselves formed in a liquid to be shielded against oxidation and are held in such liquid until used as a developer.

The carrier liquid must of course have an electrical resistivity sufficiently high, such as $10^{10}$ ohm. centimetre, to insure that the latent electrostatic image, if such is being developed, is not destroyed during development.

As the basic substances which form the developer are insulators an, excess of one of the components of the developer in the solvent which may be the carrier is not of importance because the total resistivity will not be significantly lowered.

The invention thus comprises the formation of a complex which when held in a carrier liquid will form a developer consisting of insulated pigment material having a charge characteristic such that the compound particles form an effective developer.

A number of examples will be set out herein, and, in connection with these, it is pointed out that the substances used can be variously selected.

Thus, in Example 1 and the following examples, the two substances which form the complex are normally solids which dissolve in the solvent, and then form larger aggregates when suspended in a carrier liquid of lower solvent power.

In Example 8, an insulating liquid, that is the Tetralin, replaces one of the components, but this is a reactant and not simply a solvent so that the ultra-fine component is now the result of interaction of a solid with a liquid solvent.

In Example 10, two normally solid substances are combined with a liquid which is the solvent but is also a reactant so that the solvent is part of the final complex.

In Example 11 is shown how substances can be melted together and the product combined with reactant solvent, after which the mixture so produced is dispersed in a solvent to form the ultra-fine component.

Thus it will be noted that, in each case, a complex is formed which is an insulator but the particles of which are generally very fine and may be too fine to be usable as a developer. However, by then suspending these in a second solvent with a lesser solvent power, which forms the main body of carrier liquid, crystal formation takes place to give particle sizes more suitable for development.

As these ultimate particles are formed by reaction in a liquid, no surface contamination takes place, and obviously as all substances are relative insulators, such particles can be held to a latent image surface, without rapid charge exchange.

It is, of course, possible that the complex comprises a nucleus plus a coating, but the significant factor is that no grinding or fragmentation of particles is required, although this could be resorted to with larger crystals.

Nor is insulating coating necessary as when carrying out the grinding in the presence of a dissolved insulator medium. Rather a developer is produced by reaction in a solvent, and the developer may be diluted with an insulating carrier liquid (second solvents) to give larger particles.

Particles on aggregate size can be controlled readily by selecting temperature conditions, difference in solvent power between initial solvent and final carrier liquid, and by control of concentration of the solutions and dispersions to avoid saturation.

It is interesting to note that the developer which follow are generally self-fixing by reaction with the surface on whih they are deposited or by locking to the surface.

(REACTIVE DEVELOPERS)

EXAMPLE 1

Developers are made within an insulating carrier liquid and from the following material as follows:

(a) QUINALIZARIN
(1,2,5,8-Tetrahydroxyanthraquinone) 0.5 gram.

(b) $\alpha$ - NITROSO $\beta$ — NAPHTHOL
(Naphthalene, 2 Hydroxy — 1 Nitroso) 0.5 gram The quinalizarin and the $\alpha$ -nitroso $\beta$ -naphthol are dissolved in 50 milliliters of the hydrocarbon solvent Esso 100 to obtain a fine precipitation which can be the actual developer but, as larger aggregates are more suitable, the basic developer so formed is diluted with 250 milliliters of Isopar G aliphatic hydrocarbon liquid which has a lower solvent power, to form a developer with larger aggregates with which electrostatic charge patterns can readily develop on insulating layers containing an electrostatic image.

"Esso 100" is a hydrocarbon solvent supplied by Esso Chemicals — boiling range 156°–171° C— aromatic content 98.9 flash point 100° F — specific gravity 0.874.

"Isopar G" is a hydrocarbon solvent supplied by Esso Chemicals — boiling range 158°–177° C—aromatic content 0.20— flash point 103° F— specific gravity 0.750.

Example 4

In Example 1, a further addition is made of CHLORANIL, 0.5 gram, to form a developer.

Example 5

In Example 1, the quinalizarin is replaced by VANILLIN which is first melted to dissolve a dye such as RHODAMINE B in the proportions of 1 part of the dye to 20 parts of the dry vanillin, by weight. RHODAMINE B (red) may be replaced by DISULPHINE BLUE or ERIOCHROME BLACK, Color Index No. 201.

Example 6

In Example 5, the vanillin is replaced by CITRAL, $C_{10}H_{16}O$, or CINNAMALDEHYDE, $C_6H_5CH : CHCHO$, or 2-NAPHTHALDEHYDE $C_{10}H_7CHO$.

Example 7

In Example 1, the quinalizarin is replaced by NAPHTHALENE $C_{10}H_8$.

Example 8

Developers are made within an insulating carrier liquid, from the following materials which also do not impair the electrical resistivity of the carrier liquids:

(a) QUINHYDRONE (Benzoquinhydrone) 0.5 gram
(b) TETRALIN (1,2,3,4 -Tetrahydronaphthalene) 100 ml.

The quinhydrone is dissolved in the tetralin and this solution is dispersed in Isopar G to form a developer giving toner particles comprising a quinhydrone-tetralin complex.

Example 9

In Example 8, the quinhydrone is replaced by HYDROQUINONE (1,4-Dihydroxy-Benzene) $C_6H_6O_2$.

Example 10

Developers are made within insulating carrier liquids as follows, and from the following materials:

(a) Diphenylamine ($\eta$- Phenylaniline) 0.5 gram.
(b) CHLORANIL (1,4-Bensoquinone, Tetrachloro) 0.5 gram
(c) TETRALIN 20 ml.

The diphenylamine and the chloranil are independently dissolved in the tetralin, and react to form a green precipitate which is then dispersed while still wet with tetralin in another insulating liquid, other than tetralin, for example Isopar G, as previously defined or Isopar H or E which differ respectively from Isopar G by having respectively a slightly lower boiling range, Isopar E being (117°–144° C—aromatic content 0.05 — flash point 103 and Isopar H with a higher boiling range (174°–191° C)—aromatic content 0.20, and flash point 120° F.

Example 11

The following materials are used to make a developer:

(a) NAPHTHALENE -2- SULPHONIC ACID, $C_{10}H_7.SO_3H_1$ 0.5 gram
(b) DIPHENYLAMINE ($\eta$- PHENYLANILINE) 0.5 gram These substances are melted together and the product is heated with 5 ml. of tetralin, followed by 10 ml. of Esso 100. The final product is dispersed in Isopar G to form a developer.

Example 12

The following materials are used to make a developer:

(a) BENZOPHENONE (phenyl ketone) $(C_6H_5)_2.CO$ 0.5 grams
(b) cupterron (ammonium salt of N-nitroso phenyl hydroxylamine) 0.1 gram.

The Benzophenone is melted and the cupferron is added to the melt with heating.

(c) FERRIC CHLORIDE Fe $Cl_3$ 0.1 gram is then added. The end product is then diluted with 2 ml. Esso 100 and the resultant product is dispersed in 50 ml. Isopar G, H or E, to give a developer.

Example 13

The following materials are used to make a developer:

(a) CHLORANIL 0.5 gram.
(b) DIPHENYL THIO CARBAZONE (DITHIZONE) 0.5 gram.

These two materials are each dissolved in 20 milliliters of Esso 100 hydrocarbon solvent and react to give a colored complex 13(c) which is then dispersed in Isopar G by pouring the Esso 100 concentrate into 100 ml. Isopar G.

Example 14

In Example 13, the diphenylthiocarbazone (dithizone) is replaced by SYM-DIPHENYL CARBAZIDE $(C_6H_5.NH.Nh)_2.Co$.

Example 15

In Example 12, the cupferron is replaced by ALIZARIN.

Example 16

In Example 13, the dithizone is replaced by sodium salt of ethylene diamine tetraacetic acid, and the Esso 100 replaced by tetralin if required.

We claim:

1. A method for making a developer for electrophotography of the type comprising an insulating carrier liquid having insulative developer particles suspended therein capable of being moved in an electrical field by said field, said method comprising reactively producing the developer particles by placing into a carrier liquid having an electrical resistivity in excess of $10^{10}$ohm. centimeter, at least two substances both soluble in the said carrier liquid and both being insulators relative to the carrier liquid and selected so that they do not reduce the electrical resistivity of the carrier liquid when dissolved therein, said substances being so selected to form, when in a dissolved state in the carrier liquid, precipitated developer particles, said substances being selected in quantity such that by reaction therebetween there is no significant surplus of either substance after reaction in the carrier liquid, and maintaining the developer particles in said carrier liquid to be shielded against oxidation by said carrier liquid until used as a developer, said carrier liquid being a hydrocarbon liquid, and said insulating substances each being respectively selected from one of the following groups consisting of:

a. quinalizarin, quinhydrone, hydroquinone, chloranil, vanillin, naphthalene, citral, cinnamaldehyde and diphenylamine, and
b. nitroso $\beta$-naphthol, tetralin, cupterron, diphenyl thio carbazone, sym-diphenyl, carbazide, alizarin, and the sodium salt of tetra-acetic acid

2. A method for making a developer according to claim 1 wherein the developer so formed is diluted with a further solvent also having an electrical resistivity in excess of $10^{10}$ ohm centimeter, said further solvent having a lower solvent power than the first solvent whereby larger developer particle aggregates are formed.

3. A method for making a developer according to claim 1, wherein at least one of the substances is a liquid compatible with the said solvent and reactive with the other substance when that substance is in a dissolved state.

4. A method for making a developer according to claim 1 wherein at least one of said substances before solution is dyed to give a selected color.

5. A method for making a developer according to claim 1 comprising using vanillin as one of the soluble substances which is melted to absorb a dye prior to being placed into the solvent.

6. A method for making a developer according to claim 1 wherein the developer so formed is added to a second solvent which is also an insulator but of lower solvent power than the first solvent whereby to form larger developer aggregates.

7. A method for making a developer as claimed in claim 1 wherein said two substances are quinalizarin and α-nitroso β-naphthol.

* * * * *